United States Patent [19]

Meston et al.

[11] Patent Number: 4,714,216

[45] Date of Patent: Dec. 22, 1987

[54] FIN ERECTING MECHANISMS

[75] Inventors: Spencer D. Meston; John W. Phillips, both of Bristol, United Kingdom

[73] Assignee: British Aerospace Public Limited Company, England

[21] Appl. No.: 843,382

[22] Filed: Mar. 24, 1986

[30] Foreign Application Priority Data

Mar. 23, 1985 [GB] United Kingdom ..... 8507614

[51] Int. Cl.[4] ..... B64C 5/12

[52] U.S. Cl. ..... 244/3.29; 244/49

[58] Field of Search ..... 244/49, 3.27, 3.28, 244/3.29

[56] References Cited

U.S. PATENT DOCUMENTS

| | | | |
|---|---|---|---|
| 3,918,664 | 11/1975 | Grosswendt | 244/3.28 |
| 3,990,656 | 11/1976 | Minnich . | |
| 3,998,407 | 12/1976 | Marburger et al. | 244/3.28 |

FOREIGN PATENT DOCUMENTS

| | | | |
|---|---|---|---|
| 1199664 | 8/1965 | Fed. Rep. of Germany | 244/3.29 |
| 285092 | 3/1931 | Italy | 244/3.28 |
| 154665 | 3/1956 | Sweden | 244/3.28 |
| 1431619 | 7/1974 | United Kingdom . | |
| 2136930 | 2/1984 | United Kingdom . | |

*Primary Examiner*—Galen Barefoot

*Attorney, Agent, or Firm*—Stevens, Davis, Miller & Mosher

[57] ABSTRACT

A fin (1) suitable for stabilizing the flight of a projectile for example, is formed with an integral cantilever spring member (4). The fin (1) is rotatable about a pivot (3) from an initial stowed position (not shown) to a deployed position. The spring (4) is initially retained against the fin (1) but when it is released, the fin is forced outwards to its deployed position by the action of the spring (4), the free end of the spring moving into engagement with a surface (7) to retain the fin in the deployed position.

14 Claims, 3 Drawing Figures

FIN ERECTING MECHANISMS

This invention relates to fin erecting mechanisms and is more particularly concerned with spring actuators for deplyong stabilising fins on board a projectile such as a guided weapon.

According to one aspect of the present invention, there is provided a fin erecting mechanism comprising support means; a fin member pivotably attached to the support means and which is movable from a stowed to a deployed position; and spring means attached to the fin member at one end and which is supported by the support means at the other end, the spring means being operable to deploy the fin member by moving it from its stowed to its deployed position.

Advantageously, the spring means is further operable to retain the fin member in its deployed position.

Preferably, the spring means is a cantilevered spring and forms an integral part of the fin member.

According to a second aspect of the invention, there is provided a projectile having a flight control surface defining member which is pivotably mounted to the body of the projectile for turning movement between a stowed position and an operative position in which the member projects radially from said body to an extent greater than when it is in said stowed position, an elongate spring element being positioned between said member and said body with one of its ends fixed with respect to the element and its other end in engagement with fixed abutment means relatively near the position at which the member is pivotably mounted, the spring element being operable to urge said member from said stowed to said operative position.

Advantageously, the spring element engaging surface of said abutment means is shaped, so that, in the direction towards said one end of the spring element, it becomes closer to the longitudinal axis of the projectile, the surface comprising a first portion with which said other end of the spring element engages when the member is in said stowed position and a second portion which has a greater slope than the first portion and with which the said other end of the spring element moves into engagement when the member moves to said operative position. By way of example, the first and second portions may both be flat and sloping but with the second portion steeper than the first or the surface may be curved.

Preferably, the member has an abutment surface which engages the abutment means when the member is in its operative position to limit movement of the member past that position.

For a better understanding of the invention, reference will now be made, by way of example, to the accompanying drawings in which.

Figure 1:
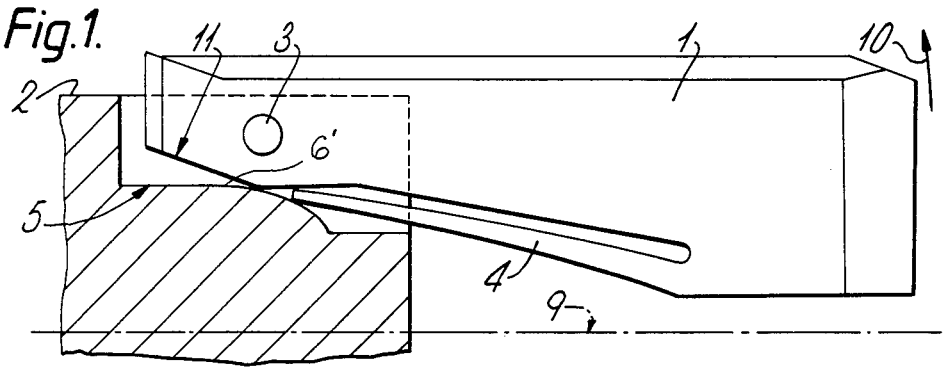
FIG. 1 is a side elevation of a fin in its stowed position mounted on board a missile, the missile itself not being shown.
Figure 2:
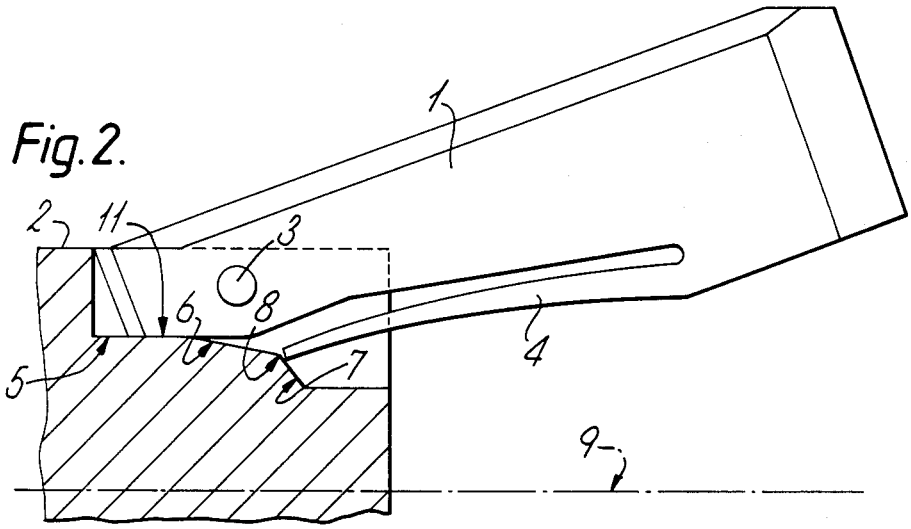
FIG. 2 is a FIG. 1 fin in its deployed position.

The fin 1 shown in the FIGS. 1 and 2, is mounted on a support structure 2 which forms part of the missile body (not shown), via a pivot 3 which allows rotational movement of the fin 1 with respect to the support 2. The fin 1 has a tapered cantilevered spring member 4 which is integrally formed with it, the spring 4 being tapered so that the greatest force is obtained for a given deflection for a near constant stress level within the elastic limits of the material. The support 2 comprises an abutment portion 5, and a single curved surface 6' as shown in FIG. 1 or two sloping mating surfaces 6 and 7 which are connected together by means of a 'knee' portion 8 as shown in FIG. 2.

Figure 3:
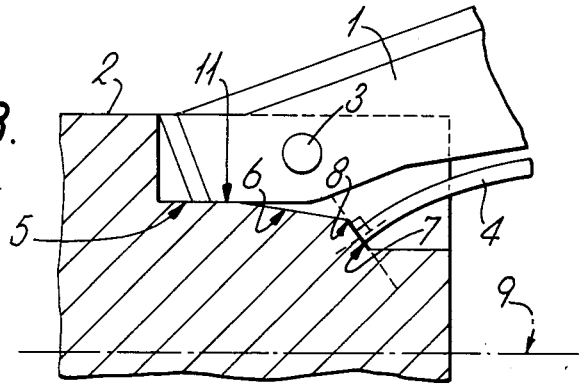
FIG. 3 shows the spring of the FIG. 1 fin arranged to lock the fin in its deployed position.

In the stowed position i.e. with the fin in towards the missile axis, the fin 1 lies parallel to the axis 9 and is retained in position with one end of the spring 4 lying in contact with the mating surface 6, by retaining means (not shown), against the action of the spring member. When the fin is deployed i.e. the retaining means released, the fin 1 is pushed upwards in the direction of the arrow 10 in FIG. 1 by the action of the spring 4, until an angled portion 11 of the fin engages with the abutment 5 as in FIG. 2. In this position, the spring 4 is no longer in contact with the surface 6 but has passed over the 'knee' 8 and is in contact with the other surface 7. The fin 1 tends to be maintained in this position as a relatively large force is required to return the spring 4 up the surface 7 and back over the 'knee' 8. In FIGS. 2 and 3 the surfaces 6 and 7 and the 'knee' 8 may be replaced by the curved surface 6' as in FIG. 1.

With the arrangement as described, the deployment of the fin 1 may be tested and the fin 1 can then be restored to its stowed position by applying a great enough force.

As an alternative it may be desirable that the fin 1 is locked in its deployed position. This is shown in FIG. 3. Locking of the fin 1 in its deployed position is achieved if the free end of the spring 4 is normal to the surface 7. Once locked, the fin 1 can only be restored by physically deflecting the end of the spring 4 and not by applying a force directly on to the fin itself.

Naturally, a plurality of such fins may be mounted on board a missile and may be used to stabilise the flight of the missile by controlling the spin rate. These fins may be mounted at the back of the missile and/or may be fully stowed inside the missile body before deployment.

We claim:

1. A fin erecting mechanism comprising:

support means;

a fin member including means for pivotably attaching said fin member to the support means and which is movable from a stowed to a deployed position; and spring means attached to the fin member at one end and which is supported by the support means at the other end, the spring means being operable to deploy the fin member by moving it from its stowed to its deployed position said spring means comprising a cantilever, said cantilever attached to said fin member at a point remote from said attached means, said cantilever having a free end extending toward said attaching means.

2. A mechanism according to claim 1, wherein the spring means is further operable to retain the fin member in its deployed position.

3. A mechanism according to claim 1 or 2, wherein the spring means is an integral part of the fin member.

4. A projectile having a flight control surface defining member, means for pivotally mounting said member to the body of the projectile for turning movement between a stowed position and an operative position in which the member projects radially from said body to an extent greater than when it is in said stowed position, an elongate spring element being positioned between said member and said body with one of its ends fixed with respect to the element and its other end in engagement with fixed abutment means relatively near the position at which the member is pivotably mounted, the spring element being operable to urge said member from said stowed to said operative position, said spring element comprising a cantilever, said cantilever attached to said member at a point remote from said pivotally mounting means, said cantilever having a free end extending toward said pivotally mounting means.

5. A projectile according to claim 4, wherein the spring element engaging surface of said abutment means is shaped, so that, in the direction towards said one end of the spring element, it becomes closer to the longitudinal axis of the projectile, the surface comprising a first portion with which said other end of the spring element engages when the member is in said stowed position and a second portion which has a greater slope than the first portion and with which the said other end of the spring element moves into engagement when the member moves to said operative position.

6. A projectile according to claim 5, wherein the first and second portions are both flat and sloping but with the second portion steeper than the first.

7. A projectile according to claim 5, wherein the surface is curved.

8. A projectile according to any one of claims 5 to 7, wherein the member has an abutment surface which engages the abutment means when the member is in its operative position to limit movement of the member past that position.

9. A fin erecting mechanism for erecting a fin from a stowed position to a deployed position, wherein said fin is carried by a support structure, said mechanism comprising:

means for pivotally mounting said fin on said support structure;

cantilever spring means integral with and connected to said fin at a point remote from said mounting means, for urging said fin towards said deployed position, said spring means including an arm generally extending toward said mounting means; and profiled surface means for compressing said spring means when said fin is in said stowed position.

10. The fin erecting mechanism according to claim 9, wherein said profiled surface means includes at least two surfaces, a first surface in contact with said spring means when said fin is in said stowed position, said first surface comprising means for permitting little spring movement relative to said first surface for a given pivotal movement of said fin toward said deployed position, and a second surface in contact with said spring means when said fin moves to its fully deployed position, said second surface comprises means for permitting greater spring movement relative to said second surface for said given pivotal movement of said fin toward said deployed position.

11. The fin erecting mechanism according to claim 10, wherein said first surface and said second surface are joined at a knee.

12. The fin erecting mechanism according to claim 10, wherein said first surface and said second surface are joined by a curved surface.

13. The projectile according to claim 4, wherein said fixed abutment means includes a profiled surface, said profiled surface and said elongate spring element other end in combination comprising a means for maintaining said member in said operative position.

14. The projectile in accordance with claim 13, wherein said means for maintaining comprises a surface in contact with said spring element other end, said spring element other end extending generally perpendicular to said maintaining means surface.

* * * * *